US008034519B2

(12) United States Patent
Sakimura et al.

(10) Patent No.: US 8,034,519 B2
(45) Date of Patent: Oct. 11, 2011

(54) ELECTROPHOTOGRAPHIC PHOTORECEPTOR AND IMAGE FORMATION METHOD

(75) Inventors: Tomoko Sakimura, Tokyo (JP); Toyoko Shibata, Kanagawa (JP); Shinichi Hamaguchi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 668 days.

(21) Appl. No.: 12/139,648

(22) Filed: Jun. 16, 2008

(65) Prior Publication Data

US 2009/0011348 A1 Jan. 8, 2009

(30) Foreign Application Priority Data

Jul. 5, 2007 (JP) ..... 2007-177146

(51) Int. Cl.
*G03G 5/00* (2006.01)

(52) U.S. Cl. ..... 430/58.8; 430/58.25; 430/59.1; 430/71; 430/72; 430/123.4; 430/123.43

(58) Field of Classification Search ..... 430/58.05, 430/58.25, 58.75, 58.8, 59.1, 71, 72, 123.4, 430/123.43

See application file for complete search history.

(56) References Cited

U.S. PATENT DOCUMENTS 4,925,760 A * 5/1990 Baranyi et al. ..... 430/58.8
2004/0126683 A1* 7/2004 Jin et al. ..... 430/58.2
2006/0188798 A1* 8/2006 Tokutake et al. ..... 430/60

* cited by examiner

*Primary Examiner* — Christopher Rodee
*Assistant Examiner* — Stewart Fraser
(74) *Attorney, Agent, or Firm* — Lucas & Mercanti, LLP

(57) ABSTRACT

Disclosed is an electrophotographic photoreceptor comprising on or over an electrically conductive support a photosensitive layer containing a pyranthrone compound represented by the following formula and the pyranthrone compound has a crystal structure exhibiting a CuKα X-ray diffraction spectrum having peaks at angles (2θ±0.2°) of 12.3°, 20.5°, 25.3° and 28.3°.

15 Claims, 2 Drawing Sheets

ELECTROPHOTOGRAPHIC PHOTORECEPTOR AND IMAGE FORMATION METHOD

FIELD OF THE INVENTION

The present invention relates to electrophotographic photoreceptors used for image formation of an electrophotographic system and an image formation method by use thereof.

BACKGROUND OF THE INVENTION

Recently, in the field of image forming technology for copiers and printers, image formation to realize dot image reproduction at a level of 1200 dpi (dpi; number of dots per inch or 2.54 cm) has become feasible with progress of digital technology. It is effective to employ a semiconductor laser as a light source for exposure to perform such fine-dot image formation. Semiconductor lasers can be made to shorten their lasing wavelengths, which is effective to form a latent image at a smaller spot diameter. Recently, development of light-emitting diode technology has enabled realization of a laser at an emission wavelength as short as 350 to 500 nm Thus, shortening the wavelength of the light source for exposure has been promoted with the progress of semiconductor laser technologies, enabling to form images at a further smaller dot level and accelerating enhancement of resolution of electrophotographic images.

Meanwhile, designing a photoreceptor suitable for exposure light at such short wavelengths as described above is necessary to realize high resolution electrophotographic images and accordingly, it is an essential point to choose a compound, called a charge generation material to generate an electric charge on the photoreceptor upon exposure to light. There have been studied so far charge generation materials suitable for a short wavelength laser light. Specifically, the use of an α-type titanyl phthalocyanine as a charge generation material achieved a photoreceptor suitable for a laser light at an emission wavelength of 400 to 500 nm, as set forth in, for example, JP-A No. 9-240051 (hereinafter, the term "JP-A" refers to Japanese Patent Application Publication) but a satisfactory function has not come into effect for a light near 400 nm.

Consequently, there have been studied photoreceptors exhibiting enhanced sensitivity at an emission wavelength of not more than 400 nm For instance, an electrophotographic photoreceptor exhibiting a sensitivity to a laser light of 380 to 500 nm was developed by use of polycyclic quinone compounds or perylene compounds having a specific structure, as set forth in, for example, JP-A No. 2000-47408.

SUMMARY OF THE INVENTION

However, when image formation was performed at a lasing wavelength of 350 to 500 nm by using an electrophotographic photoreceptor prepared by the method described in the foregoing patent document, a photoreceptor capable of performing superior image formation became feasible, whereas sufficient image formation was not achieved. Thus, it was proved that stable production of a photoreceptor exhibiting high sensitivity was extremely difficult. Specifically, sensitivity was lowered with repeating image formation, resulting in increased dark decay. Black spots were also observed in places on the image. Along therewith, when image formation was performed by a short-wavelength laser of 350 to 500 nm, there was observed the tendency that highly precise image formation was not performed efficiently.

The present invention has come into being in view of the foregoing problems and is to stably provide an electrophotographic photoreceptor exhibiting enhanced sensitivity upon exposure to a short wavelength light at a lasing wavelength of 350 to 500 nm. Specifically, it is an object of the invention to provide an electrophotographic photoreceptor which does not lower sensitivity when exposed to a so-called short-wavelength light source at a lasing wavelength in the range of 350 to 500 nm and almost no variation in electric potential at the lighted and unlighted portions even after repeatedly used. It is another object of the invention to provide an electrophotographic photoreceptor capable of forming print images without causing image defects such as black spots and achieving excellent fine-dot reproduction and fine-line reproduction.

The foregoing problems were confirmed to be overcome by the following constitution.

Thus, one aspect of the invention is directed to an electrophotographic photoreceptor comprising on or over an electrically conductive support a photosensitive layer containing a charge generation material of a pyranthrone compound with attached bromine atoms and represented by the following formula (1) and the pyranthrone compound has a crystal structure exhibiting a CuKα X-ray diffraction spectrum having peaks at Bragg angles (2θ±0.2°) of 12.3°, 20.5°; 25.3° and 28.3°:

Formula (1)

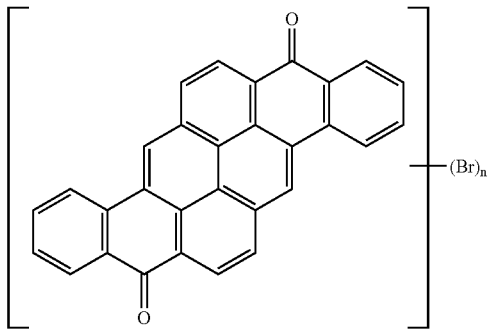

wherein n is an integer of 1 to 6.

Another aspect of the invention is directed to an image forming method comprising exposing an electrophotographic photoreceptor as described above to light by using an exposure device having a lasing wavelength of 350 to 500 nm and an exposure diameter of 10 to 50 μm in the main scanning direction of writing.

According to the invention, there is provided an electrophotographic photoreceptor exhibiting enhanced sensitivity characteristics when exposed to a short-wavelength light having a lasing wavelength of 350 to 500 nm. Thus, the electrophotographic photoreceptor related to the invention exhibited slight lowering of sensitivity when exposed to a short-wavelength light having a lasing wavelength in the range of 350 to 500 nm and also resulted in little variation in electric potential in exposed and unexposed portions even when repeatedly exposed. Further, it was confirmed that performing print formation by using an electrophotographic photoreceptor relating to the invention achieved faithful reproduction of dot images and fine-line images, without causing image trouble such as black spots.

DETAILED DESCRIPTION OF THE INVENTION

First, there will be described pyranthrone compounds usable in the invention. The electrophotographic photoreceptor relating to the invention includes a pyranthrone compound exhibiting an X-ray diffraction spectrum using CuKα radiation and having peaks at Bragg angles (2θ±0.2°) of 12.3°, 20.5°, 25.3° and 28.3° and having a structure with attached 1-6 bromine atoms in the molecule. The pyranthrone compound has a structure represented by the following formula (1):

formula (1)

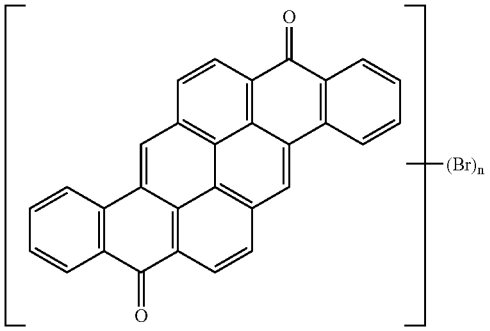

wherein n is an integer of 1 to 6.

The pyranthrone compound represented by formula (1) has a structure having 1 to 6 bromine atoms attached in the molecule. Specific examples of the pyranthrone compound having 1 to 6 bromine atoms attached in the molecule are shown below, but pyranthrone compounds usable in the invention are by no means limited to these.

C-1

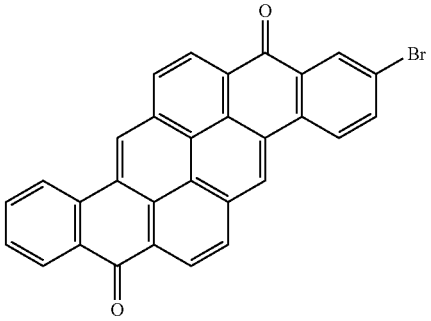

C-2

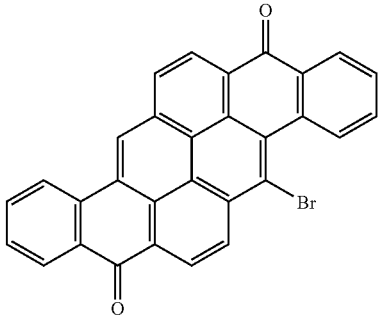

-continued

C-3

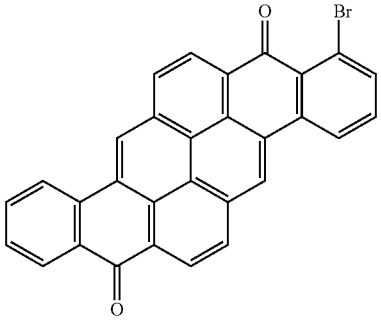

C-4

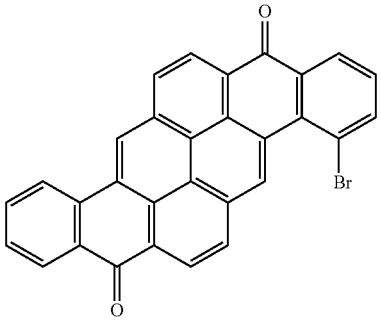

C-5

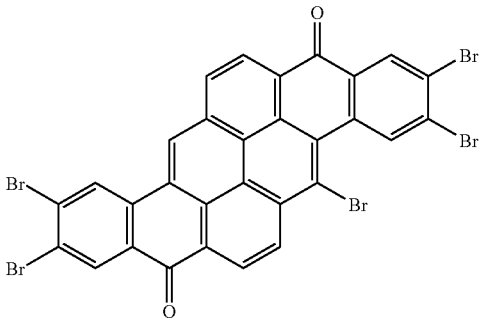

C-6

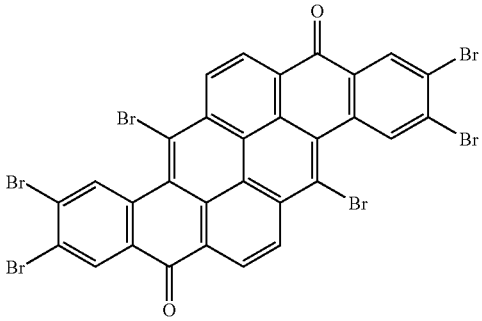

C-7

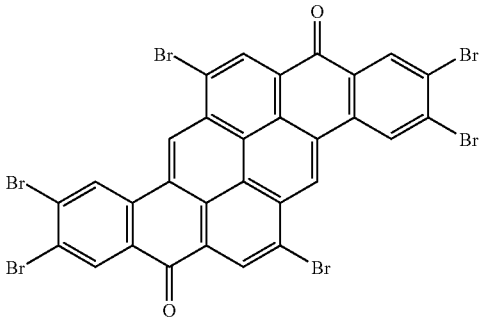

-continued
C-8
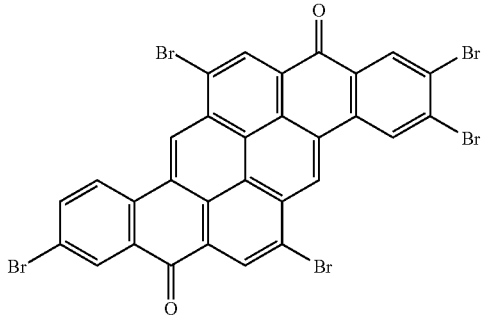
C-9
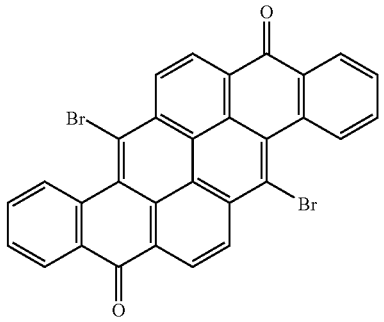
C-10
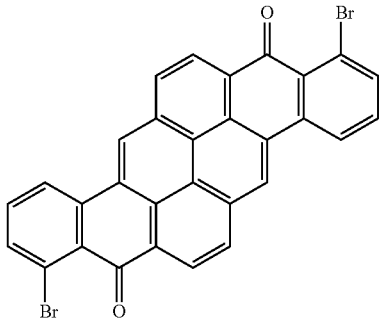
C-11
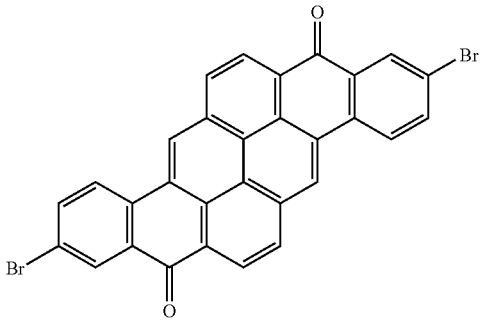
C-12
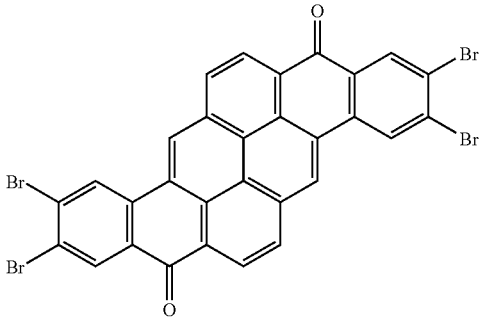
-continued
C-13
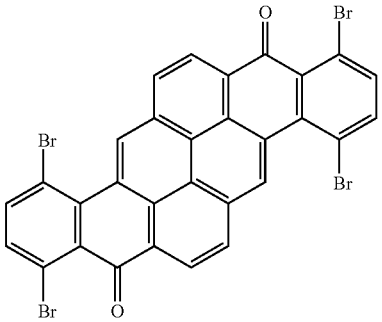
C-14
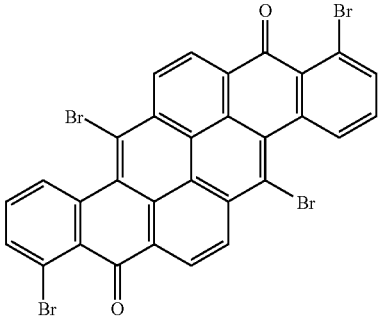
C-15
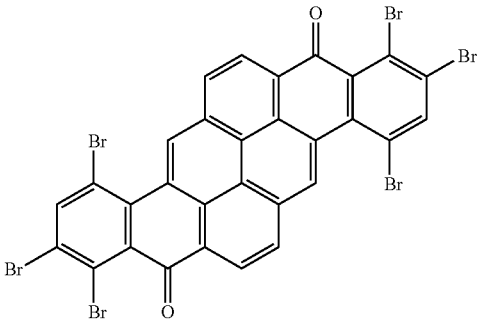
C-16
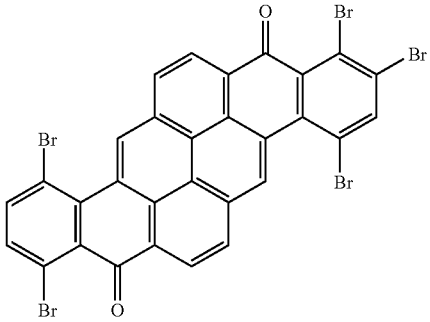
C-17
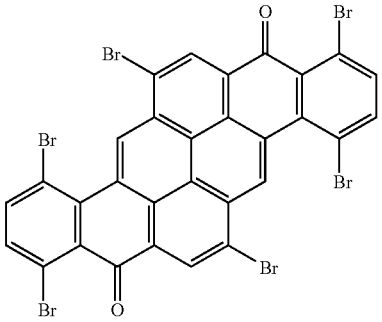

-continued

C-18

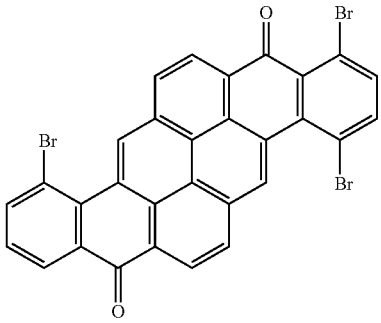

C-19

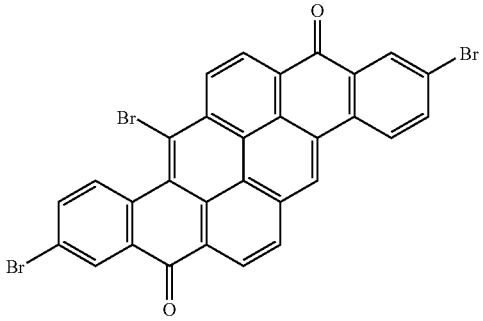

C-20

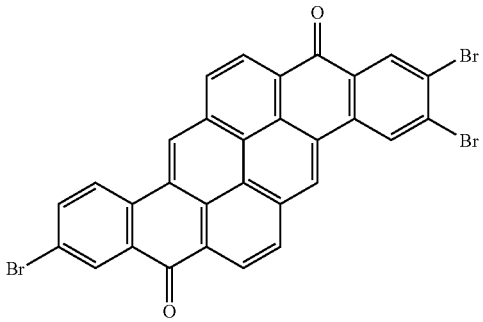

The number of attached bromine atoms in the molecular structure of the pyranthrone compound represented by the formula (1) can be controlled by varying the added amount of bromine. The number of attached bromine atoms in the molecular structure of the pyranthrone compound can be determined in commonly used mass spectrometry.

Next, there will be described X-ray diffraction spectrum.

Pyranthrone compounds usable in the invention have a crystal structure exhibiting an X-ray diffraction spectrum using CuKα radiation as a radiation source and having peaks at Bragg angles (2θ±0.2°) of 12.3°, 20.5°, 25.3° and 28.3°. These peaks are those represented by sharp-projected portions on a spectrum chart prepared in X-ray diffraction spectroscopy, which are definitely different in form from noises on the spectrum chart. However, the order of peak height is not defined between these four peaks.

Figure 2:
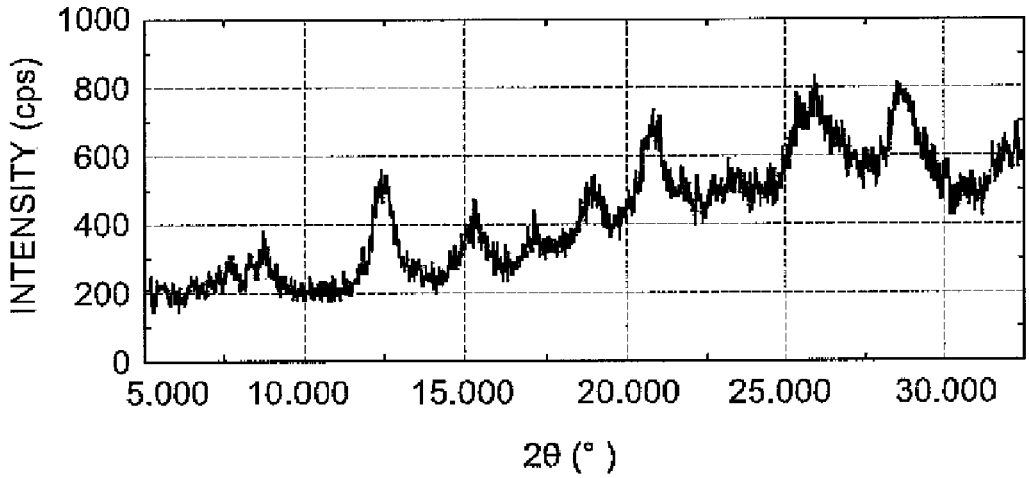
FIG. 2 illustrates an example of a CuKα X-ray diffraction spectrum of one of the pyranthrone compounds used in the invention.

Pyranthrone compounds usable in the invention may be those having other peaks in addition to the peaks at the foregoing Bragg angles (2θ±0.2°) but the foregoing four peaks at angles of 12.3°, 20.5°, 25.3° and 28.3° are evidently distinguished from such other peaks. FIG. 2 illustrates an example of a CuKα X-ray diffraction profile of the pyranthrone compound usable in the invention, in which the foregoing four peaks at angles of 12.3°, 20.5°, 25.3° and 28.3° are definitely identified.

Measurement methods of CuKα X-ray diffraction spectrum include conventionally known methods such as a powder method and a thin-layer method, which use CuKα radiation (wavelength: 1.54178 Å) as a radiation source. In the following, there will be described a thin-layer method as one of measurements methods of X-ray diffraction spectrum. The X-ray diffraction spectrum measurement has such a merit in that a thin-layer X-ray diffraction spectra of a photosensitive layer itself can be obtained. In one measured example, a photosensitive layer is formed on the surface of a glass plate, which is then subjected to measurement. In the following, there will be concretely described the procedure of measurement of the CuKα X-ray diffraction spectrum of the photosensitive layer.

(1) Preparation of Measurement Sample:

On a non-refractive cover glass is coated a coating solution of a photosensitive layer to form a 10 μm thick dry layer and dried.

(2) Measurement Apparatus and Condition:

An apparatus for measuring X-ray diffraction spectra employs an X-ray diffractometer for thin-layer sample measurement, using CuKα radiation as an X-ray source which has been monochromatically parallelized by an artificial multilayer mirror. There is cited, for example, Rigaku RINT2000 (Rigaku Corp.). Conditions for X-ray diffraction spectrum measurement are as follows:

X-ray output voltage: 50 kV
X-ray output current: 250 mA
Fixed incident angle (θ): 1.0°
Scanning range (2θ): 3-40°
Scanning step width: 0.05°
Incident solar slit: 5.0°
Incident slit: 0.1 mm
Light-receiving solar slit: 0.1°

Setting the apparatus to the foregoing conditions is performed measurement of X-ray diffraction spectra.

The reason why the photoreceptor relating to the invention exhibits a superior sensitivity characteristic to short-wavelength light of 350 to 500 nm is not fully understood but it is assumed that this pyranthrone compound contributes to enhancement of dispersibility in a coating solution. Thus, it is assumed that a crystalline pyranthrone which exhibits peaks at 12.3°, 20.5°, 25.3° and 28.3° causes an optimal repulsive power between crystal particles, whereby aggregation of crystal particles is avoided by the action of this repulsive force, resulting in a homogeneous dispersion of pyranthrone compound particles in a coating solution.

In the invention, it was found that superior sensitivity characteristic to short-wavelength light at a lasing wavelength in the range of 350 to 500 nm is achieved by use of a pyranthrone compound having a crystal structure exhibiting peaks at 12.3°, 20.5°, 25.3+ and 28.3°. There has been known an organic photoreceptor technique of using pyranthrone compounds as a charge generation material, as described in JP-A Nos. 55-17105 and 2000-47408. However, the prior art does not suggest any finding that a photoreceptor exhibiting superior sensitivity characteristic to a short-wavelength light of 350 to 500 nm was obtained by use of a pyranthrone compound having a specific crystal structure. In fact, it was found for the first time in the invention that the pyranthrone compound having a crystal structure exhibiting peaks at Bragg angles (2θ±0.2°) of 12.3°, 20.5°, 25.3° and 28.3° came into effects, as described above.

Compounds which have a crystal structure exhibiting an X-ray diffraction spectrum using a Cuα X-ray source, having peaks at Bragg angles (2θ±0.2°) of 12.3°, 20.5°, 25.3+ and 28.3° can be prepared, for example, according to the following procedure.

(1) First, a pyranthrone compound in an amorphous state is synthesized in accordance with a conventionally known method.

(2) Next, the foregoing pyranthrone compound is treated by a conventionally known purification method to obtain an objective pyranthrone compound exhibiting peaks at 12.3°, 20.5°, 25.3° and 28.3°.

In the purification of a pyranthrone compound, repeating the purification operation plural times results in an increased content of the pyranthrone compound exhibiting peaks at 12.3°, 20.5°, 25.3° and 28.3°, leading to enhancement of the purity. Thus, repetition of the purification operation results in enhanced mass ratio or purity of the pyranthrone compound exhibiting peaks at 12.3°, 20.5°, 25.3° and 28.3°, and this is assumed to be due to that pyranthrone molecules form a specific crystal structure.

In other words, it is assumed that repetition of purification prolongs the purification time so that more pyranthrone molecules participate in formation of the crystal structure exhibiting peaks at 12.3°, 20.5°, 25.3° and 28.3°, resulting in increased mass ratio or purity thereof. It is contemplated that such a crystal structure is the most stable among crystal structures of pyranthrone molecules, promoting the crystal formation.

Purification methods to form the pyranthrone compound exhibiting peaks at 12.3°, 20.5°, 25.3° and 28.3° include a purification method via sublimation such as a multistage sublimation purification or fractional sublimation purification, and heating treatment in a high boiling solvent.

To obtain the pyranthrone compound represented by formula (1), an initially performed synthesis method of the pyranthrone compound is not specifically limited but a typical synthesis example is described below.

First, 5.0 parts by mass of 8,16-pyranthrenedione and 0.25 part by mass of iodine are dissolved in 50 parts by mass of chlorosulfuric acid and further thereto, 5.9 parts by mass of bromine are dropwise added. After completing addition, the reaction mixture is heated to 70° C. and stirred for 5 hrs. with heating to undergo reaction. After completion of the reaction, the reaction mixture is cooled to room temperature and poured into 500 parts by mass of ice. After filtering the reaction mixture, washing is repeated until the washing liquid becomes neutral and then, drying is performed to obtain a pyranthrone compound with attached bromine atoms.

As a result of mass spectrometry of the obtained pyranthrone compound, it was proved to have a structure with four attached bromine atoms. Further, CuKα X-ray diffractometry of the pyranthrone compound did not identify four peaks at 12.3°, 20.5°, 25.3+ and 28.3°.

Reaction was also performed similarly to the foregoing, except that the addition amount of bromine was changed to 1.5 parts by mass to control the number of bromine atoms attached to a pyranthrone compound, whereby a pyranthrone compound with a single attached bromine atom was obtained. Reaction was also performed similarly, except that the addition amount of bromine was changed to 9.0 parts by mass, whereby a pyranthrone compound with six attached bromine atoms was obtained. Further, reaction was also performed similarly, except that the addition amount of bromine was changed to 4.5 parts by mass, whereby a pyranthrone compound with attached three bromine atoms was obtained. Yet further, reaction was also performed similarly, except that the addition amount of bromine was changed to 74.5 parts by mass, whereby a pyranthrone compound with five attached bromine atoms was obtained. Thus, as shown in the foregoing synthesis examples, the number of bromine atoms attached to a pyranthrone compound can be controlled by varying the addition amount of bromine in the reaction.

Next, there will be described a purification method of the compounds prepared in the foregoing synthesis examples. Pyranthrone compounds exhibiting peaks at 12.3°, 20.5°, 25.3° and 28.3°, used in the invention are prepared by repeating purification. The pyranthrone compounds prepared in the foregoing synthesis examples become a pyranthrone compound having the foregoing crystal structure. Specific examples of a purification method include a sublimation method such as a multistage sublimation purification method or a fractional sublimation purification method, and a heat-treatment purification method. There will be further described these purification methods.

(1) Multistage Sublimation Purification Method

The multistage sublimation purification method performs purification of a pyranthrone compound through at least two sublimation stages. In the first stage, at a temperature slightly higher than the sublimation temperature of a pyranthrone compound, 1 to 10% by mass of the whole pyranthrone compound is sublimated and condensed onto the first substrate. Subsequently, in the second stage or later, the pyranthrone compound is sublimated at a temperature higher than the sublimation temperature of the pyranthrone compound by 10 to 100° C. and condenses onto the second substrate. Thus, performing multistage sublimation results in formation of a pyranthrone compound exhibiting peaks at 12.3°, 20.5°, 25.3° and 28.3° at a purity containing no volatile or degradation impurity. The multistage sublimation purification is feasible at three or more sublimation stages.

PURIFICATION EXAMPLE 1

Multistage Sublimation Purification

In the first stage, 15 parts by mass of a pyranthrone compound prepared in the foregoing synthesis example was placed into a crucible and the chamber of a sublimation apparatus was evacuated to approximately $1\times10^{-2}$ Pa. Under reduced pressure, the crucible was heated to 420° C. and maintained for 10 min. at 420° C. Then, heating was stopped and cooling was started and when the crucible temperature reached 200° C. or lower, the pressure within the chamber was returned to atmospheric pressure. In fact, when a pyranthrone compound obtained after completing the first sublimation stage was observed in CuKα X-ray diffraction, there were identified peaks at Bragg angles other than 12.3°, 20.5°, 25.3° and 28.3°.

In the second stage, the chamber of a sublimation apparatus was evacuated to approximately $1\times10^{-2}$ Pa. Under reduced pressure, the crucible was heated to 450° C. and a heat treatment was conducted for 2 hr. Then, heating was stopped and cooling was started and when the crucible temperature reached 200° C. or lower, the pressure within the chamber was returned to atmospheric pressure. In fact, when a pyranthrone compound obtained after completing the second sublimation stage was observed in CuKα X-ray diffraction, there were identified peaks at Bragg angles of 12.3°, 20.5°, 25.3° and 28.3°, and there were also observed barely observable other small peaks.

In the third stage, the chamber of a sublimation apparatus is evacuated to $1\times10^{-2}$ Pa. Under reduced pressure, the crucible was heated to 480° C. and a heat treatment was conducted for 2 hr. Then, heating was stopped and cooling was started and when the crucible temperature reached 200° C. or lower, the pressure within the chamber was returned to atmospheric pressure. When a pyranthrone compound obtained after completing the third sublimation stage was observed in CuKα X-ray diffraction, the peaks at Bragg angles of 12.3°, 20.5°, 25.3° and 28.3 became much larger than those of the pyranthrone compound obtained in the second stage and no other peaks were observed.

(2) Fractional Sublimation Purification Method

Fractional sublimation purification methods include a purification method called train sublimation method. For example, a pyranthrone compound is placed into a glass tube having a temperature gradient and the heating position on the glass tube is stepwise varied, enabling to stepwise change the temperature of heating the pyranthrone compound. Thus, a method of performing sublimation purification with stepwise changing heating temperatures is called a fractional sublimation purification method.

The specific procedure of a sublimation purification method is as follows.

First, a pigment is heat-treated is, at the first position, at a temperature ($T_1$) higher than the sublimation temperature of a pyranthrone compound by 10 to 100° C. Positioning a glass tube to perform heating at the temperature ($T_1$), a heating treatment is conducted to vaporize the pyranthrone compound together with volatile impurities.

Subsequently, a heat-treatment is conducted by positioning the glass tube so that condensation of the pyranthrone compound is effectuated at a temperature ($T_2$) lower than the former heat-treatment by 10 to 20° C. Thus, the vapor of the pyranthrone compound sublimed in the former operation is allowed to condense. Subsequently, a heat treatment is performed with positioning the glass tube to apply heating at a temperature ($T_3$) of 10 to 20° C. lower than the temperature allowing the pyranthrone compound to condense, whereby vapor of the volatile impurities is condensed. Purification of a pyranthrone compound is performed according to the foregoing procedure to form a pyranthrone compound exhibiting peaks at 12.3°, 20.5°, 25.3° and 28.3°, as described below.

PURIFICATION EXAMPLE 2

Fractional Sublimation Purification

Into a glass tube made of Pyrex (trade name) was placed 5 parts by mass of a pyranthrone compound prepared in the synthesis examples described earlier. The glass tube was disposed in a furnace structured to provide a temperature gradient of ca. 480° C. to ca. 20° C. along the tube (capable of having a temperature gradient of ca. 480° C. to ca. 20° C. per 1 m). While the interior of the glass tube being evacuated to $1\times10^{-2}$ Pa, the position at which the glass tube containing a pyranthrone compound to be purified was disposed was heated to approximately 480° C. The thus formed vapor was moved to the lower temperature side to allow condensation. There was recovered a pyranthrone compound condensed in the region of approximately 300-420° C. The thus purified pyranthrone compound exhibited peaks at 12.3°, 20.5°, 25.3° and 28.3° but also exhibited peaks at other angles in CuKα X-ray diffractometry.

(3) Heating Purification Method in High Boiling Solvent

Method of heat-purification in a high boiling solvent is a heat treatment of an unpurified pyranthrone compound in a high boiling solvent to promote crystal formation and to allow impurities contained in the pyranthrone compound to dissolve in a high boiling solvent and then to be removed. Examples of a solvent usable in this purification method include nitrobenzene, quinoline and sulfolane. As a heating time under a high boiling solvent becomes longer, peak intensities at 12.3°, 20.5°, 25.3° and 28.3° tend to increase.

PURIFICATION EXAMPLE 3

Heating Purification

Into a crucible was placed 5 parts by mass of the pyranthrone compound synthesized in the foregoing synthesis example and after the chamber of a sublimation apparatus was evacuated to approximately $1\times10^{-2}$ Pa, the temperature of the 19 8723 crucible was increased to 450° C. and maintained for 2 hrs. to sublime the pyranthrone compound. After completing the foregoing heating treatment, cooling the crucible was started and when the crucible reached room temperature, the interior of the chamber was returned to atmospheric pressure. At that moment, the pyranthrone compound which was sublimed by heating condensed on the collector substrate provided within the chamber.

In 100 parts by mass of nitrobenzene was suspended 1.0 part by mass of the pyranthrone compound formed through the foregoing sublimation process, heated at 200° C. for 1 hr., filtered, washed with acetone and then with methanol, and dried to obtain a purified pyranthrone compound. The thus purified pyranthrone compound exhibited peaks at 12.3°, 20.5°, 25.3° and 28.3° but also exhibited peaks at other angles in CuKα X-ray diffractometry.

Next, there will be described constitution of an electrophotographic photoreceptor relating to the invention. The electrophotographic photoreceptor relating to the invention contains, as a charge generation material, a pyranthrone compound which has a crystal structure exhibiting peaks at Bragg angles of 12.3°, 20.5°, 25.3° and 28.3° in CuKα X-ray diffraction spectrum and is represented by formula (1). The electrophotographic photoreceptor relating to the invention has come into effect by containing an organic compound having at least one function of a charge generation function and a charge transfer function, and is in the category of a so-called organic photoreceptor.

The electrophotographic photoreceptor relating to the invention comprises a photosensitive layer containing the above-described pyranthrone compound as a charge generation material on or over an electrically conductive support and is preferably a so-called layered structure in which a charge generation layer and a charge transfer layer are successively layered to form a photosensitive layer. It is also preferred to provide an interlayer between the electrically conductive layer and the photosensitive layer and further preferred to provide a surface protective layer on the photosensitive layer.

In the following, an electrically conductive support, an interlayer and a photosensitive layer constituting the electrophotographic photoreceptor will be described with reference to specific examples.

(1) Conductive Support

Electrically conductive supports usable in the photoreceptor relating to the invention include sheet-form or cylindrical ones.

A cylindrical conductive support, which is capable of endless image formation on a photoreceptor through rotation of the photoreceptor, preferably has a cylindricality of 5 to 40 μm, and more preferably 7 to 30 μm. The cylindricality is defined in terms of a circularity, which is defined in JIS specification (B0621-1984). Thus, when a cylindrical substrate is sandwiched in between two coaxial geometrical cylinders, the position at which the distance between the cylinders is the shortest is represented by a difference in radius between the cylinders (that is a circularity). In the invention, the difference is represented in terms of μm.

A cylindricality is determined by measurement of circularity at two points of both 10 mm ends of the cylindrical substrate, at the center point, and four of the points equally three-divided between the center and the end, that is, for a total of seven points. Examples of an instrument for cylindrical degree measurement include a non-contact versatile roll diameter measurement instrument (produced by Mitsutoyo Co., Ltd.).

Materials used for an electrically conductive support include, for example, a metal cylinder such as aluminum or nickel, a plastic resin drum-on which aluminum, tin oxide, indium oxide or the like is deposited and a Japanese paper or plastic drum which is coated with electrically conductive material. A specific resistivity as an electric characteristic of a conductive support is preferably not more than 103 Ωcm at ordinary temperature (e.g., 25° C.).

There may be used a conductive support, the surface of which has been subjected to a sealing treatment to form an alumite layer. An alumite treatment is conducted usually in an acidic bath such as chromic acid or sulfuric acid, oxalic acid, phosphoric acid, boric acid, or sulfamic acid. Of these, it is specifically preferred to subject the support surface to an anodic oxidation treatment by using sulfuric acid. An anodic oxidation treatment in sulfuric acid is conducted preferably by setting conditions at a sulfuric acid concentration of 100 to 200 g/l, an aluminum ion concentration of 1 to 10 g/l, a liquid temperature of approximately 20° C. and an applied voltage of approximately 20 V but is not limited to these conditions. The average thickness of the formed anodic oxidation film is usually not more than 20 μm, preferably not more than 10 μm.

(2) Interlayer

The electrophotographic photoreceptor relating to the invention may be provided with an interlayer between a conductive support and a photosensitive layer. Such an interlayer preferably contains N-type semiconductor particles. The N-type semiconductor particles refer to particles exhibiting the property of the main charge carrier being electrons. In other words, since the main charge carrier is electrons, the interlayer using N-type semiconductor particles exhibits properties of efficiently blocking hole-injection from the substrate and reduced blocking for electrons from the photosensitive layer. Preferred N-type semiconductor particles include titanium oxide ($TiO_2$) and zinc oxide (ZnO), of which the titanium oxide is specifically preferred.

N-type semiconductor particles employ those having a number average primary particle size of 3 to 200 nm, and preferably 5 to 100 nm. The number average primary particle size is a Feret-direction average diameter obtained in image analysis when N-type semiconductor particles are observed by a transmission electron microscope and 1,000 particles are randomly observed as primary particles from images magnified at a factor of 10000. In cases when the number average primary particle size of N-type semiconductor particles is less than 3 nm, it becomes difficult to disperse the N-type semiconductor particles in a binder constituting an interlayer and the particles are easily aggregated, so that the aggregated particles act as a charge trap, making it easy to cause a transfer memory.

When the number average primary particle size is more than 200 nm, N-type semiconductor particles cause unevenness on the interlayer surface, tendering to cause non-uniformity of images via such unevenness. Further, when the number average primary particle size is less than 200 nm, N-type semiconductor particles easily precipitate in the dispersion, often causing image non-uniformity.

Crystal forms of titanium oxide particles include an anatase type, rutile type, brookite type and the like. Of these, rutile type or anatase type titanium oxide particles effectively enhance rectification of a charge passing the interlayer. Thus, mobility of electrons is enhanced to stabilize the charging potential, and increase of residual potential is inhibited, contributing to high-density dot image formation.

Formation of an interlayer in the electrophotographic photoreceptor relating to the invention employs preparation of an interlayer coating solution and coating it, in which the interlayer coating solution contains a binder and a dispersing solvent in addition to N-type semiconductor particles such as surface-treated titanium oxide.

The proportion of N-type semiconductor particles in the interlayer is preferably 1.0 to 2.0 times the binder resin in the interlayer by volume (in which the volume of a binder resin is set at 1). Such a high-density proportion in the interlayer results in enhanced rectification of the interlayer, rendering it difficult to cause an increase of residual potential or occurrence of transfer memory. Accordingly, occurrence of black spots is inhibited and variation in electric potential is minimized.

(3) Photosensitive Layer (a) Charge Generation Layer

The electrophotographic photoreceptor relating to the invention employs, as a charge generation material, a pyranthrone compound represented by the formula (1) described earlier and exhibiting an X-ray diffraction profile having peaks at Bragg angles of 12.3°, 20.5°, 25.3+ and 28.3°. In the invention, conventionally known charge generation materials may he used in combination with the foregoing pyranthrone compound.

A binder constituting a charge generation layer can employ commonly known resins and specifically preferred examples thereof include a formal resin, a butyral resin, a silicone resin, a silicone-modified butyral resin and a phenoxy resin. The ratio of a charge generation material to a binder resin is preferably from 20 to 600 parts by mass to 100 parts by mass of a binder resin. The use of these resins can restrain increased residual potential accompanied with repeated use. The thickness of a charge generation layer is preferably from 0.3 to 2 μm.

(b) Charge Transport Layer

A charge transport layer is composed of a charge transport material and a binder to disperse the charge transport material to form the layer. There may optionally be incorporated additives such as an antioxidant, in addition to the foregoing constituents.

A charge transport material is preferably an organic compound exhibiting low absorptivity for a laser light with an emission wavelength in the range of 350 to 500 nm. The charge transport layer may be composed of plural charge transport layers.

In the invention, it is preferred to use, as a charge transport material, at least one compound represented by the following formula (2):

formula (2)

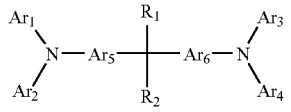

wherein $Ar_1$ to $Ar_4$ are each independently an aryl group which may be substituted, $Ar_5$ and $Ar_6$ are each an arylene group which may be substituted, provided that $Ar_1$ and $Ar_2$ or $Ar_3$ and $Ar_4$ may combine with each other to form a ring; $R_1$ and $R_2$ are each independently a hydrogen atom or an alkyl group, an aralkyl group or aryl group which may be substituted, provided that $R_1$ and $R_2$ may combine with each other to form a ring.

Of compounds represented by the foregoing formula (2) is preferred a compound represented by the following formula (3), in which the foregoing $Ar_5$ and $Ar_6$ are each a phenylene group which may be substituted:

formula (3)

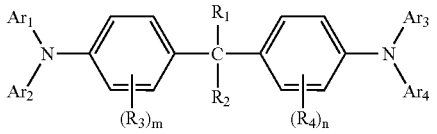

wherein $R_1$ and $R_2$ are each independently an alkyl group or an aryl group, provided that $R_1$ and $R_2$ may combine with each other to form a ring structure; $R_3$ and $R_4$ are each independently a hydrogen atom, an alkyl group or an aryl group; $Ar_1$ to $Ar_4$ are each the same as defined in the foregoing formula (2) ; m and n are each an integer of 1 to 4.

Specific examples of the compound represented by the foregoing formula (3) are shown below.

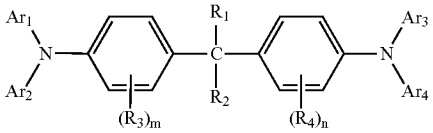
| CTM-No. | $Ar_1$ | $Ar_3$ | $Ar_2$ | $Ar_4$ | $R_1$ | $R_2$ | 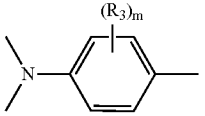 | 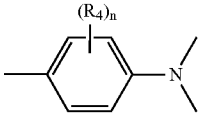 |
|---|---|---|---|---|---|---|---|---|
| CTM-1 | 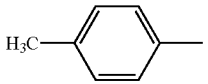 | 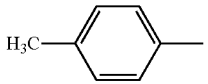 | 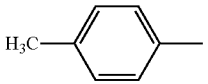 | 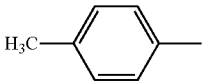 | —$CH_3$ | —$CH_3$ | 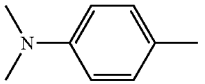 | 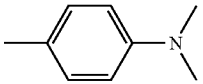 |
| CTM-2 | 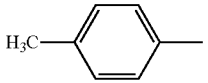 | 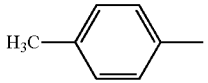 | 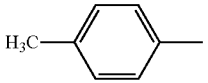 | 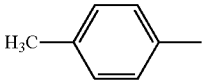 | —$CH_3$ | —$C_2H_5$ | 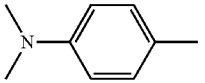 | 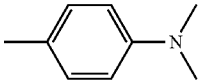 |
| CTM-3 | 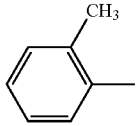 | 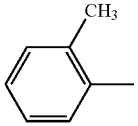 | 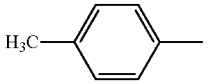 | 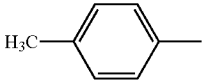 | —$CH_3$ | —$C_3H_7$(l) | 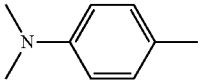 | 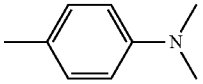 |
| CTM-4 | 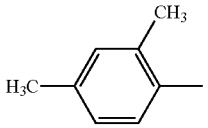 | 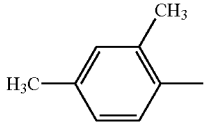 | 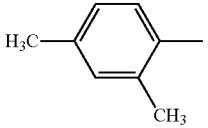 | 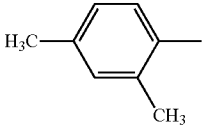 | —$CH_3$ | —$C_4H_9$(n) | 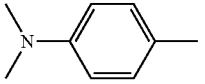 | 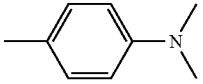 |
| CTM-5 | 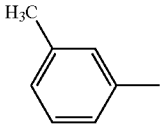 | 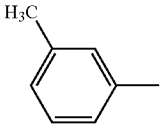 | 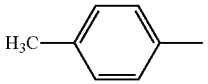 | 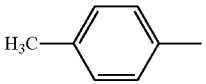 | —$CH_3$ | 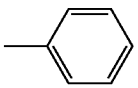 | 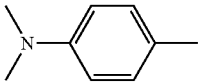 | 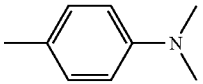 |
| CTM-6 | 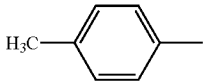 | 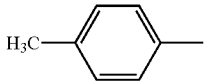 | 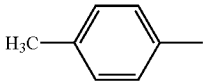 | 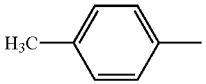 | 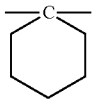 | | 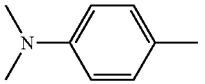 | 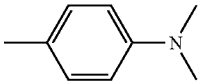 |

-continued
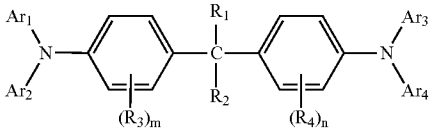
| CTM-No. | $Ar_1$ | $Ar_3$ | $Ar_2$ | $Ar_4$ | $R_1$ | $R_2$ | 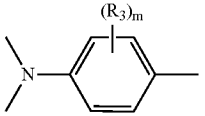 | 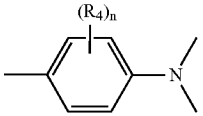 |
|---|---|---|---|---|---|---|---|---|
| CTM-7 | 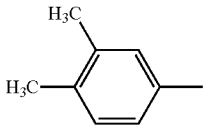 | 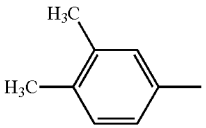 | 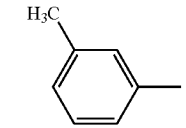 | 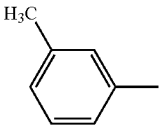 | —$CH_3$ | —$CH_3$ | 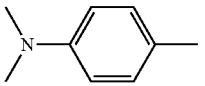 | 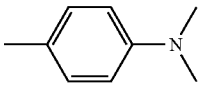 |
| CTM-8 | 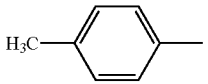 | 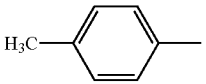 | 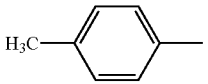 | 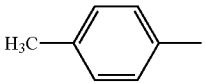 | —H | —H | 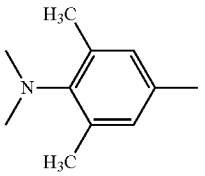 | 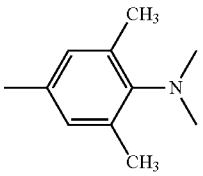 |
| CTM-9 | 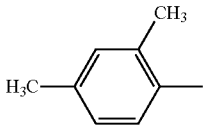 | 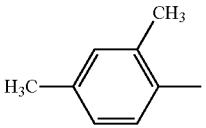 | 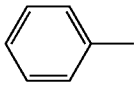 | 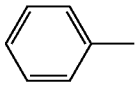 | —$CH_3$ | —$CH_3$ | 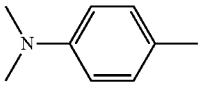 | 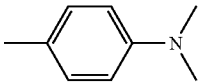 |
| CTM-10 | 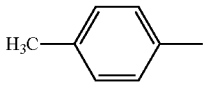 | 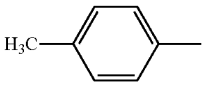 | 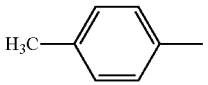 | 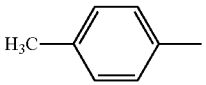 | 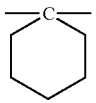 | | 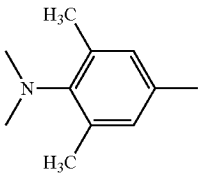 | 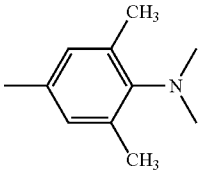 |
| CTM-11 | 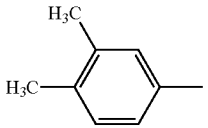 | 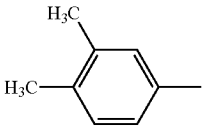 | 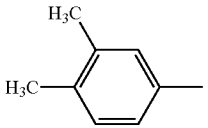 | 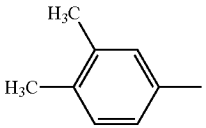 | 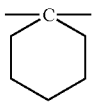 | | 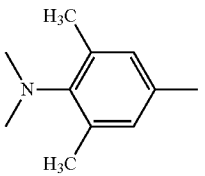 | 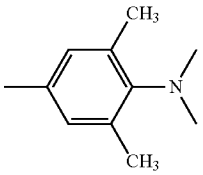 |

-continued
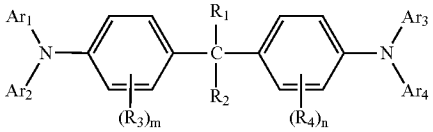
| CTM-No. | $Ar_1$ | $Ar_3$ | $Ar_2$ | $Ar_4$ | $R_1$ | $R_2$ | 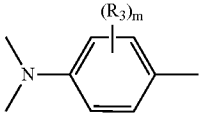 | 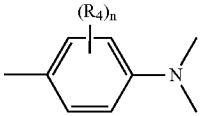 |
|---|---|---|---|---|---|---|---|---|
| CTM-12 | 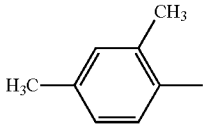 | 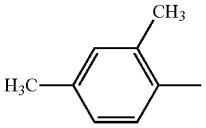 | 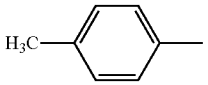 | 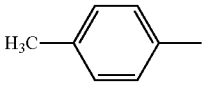 | C | | 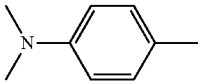 | 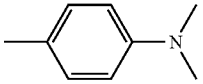 |
| CTM-13 | 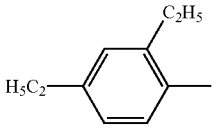 | 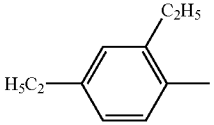 | 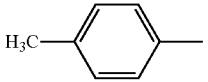 | 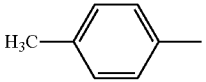 | C | | 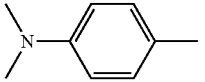 | 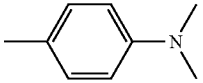 |
| CTM-14 | 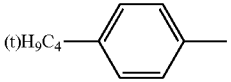 | 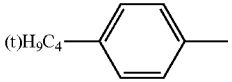 | 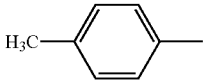 | 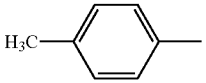 | C | | 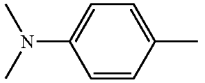 | 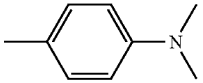 |
| CTM-15 | 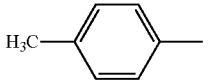 | 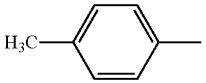 | 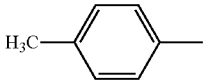 | 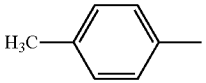 | $—C_2H_5$ | $—C_2H_5$ | 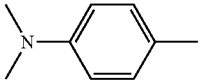 | 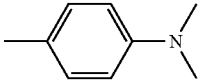 |

Compounds represented by formula (3) can be synthesized according to commonly known methods. A synthesis example of CTM-6 as one of compounds represented by formula (3) is shown below.

Synthesis Example of Compound (CTM-6):

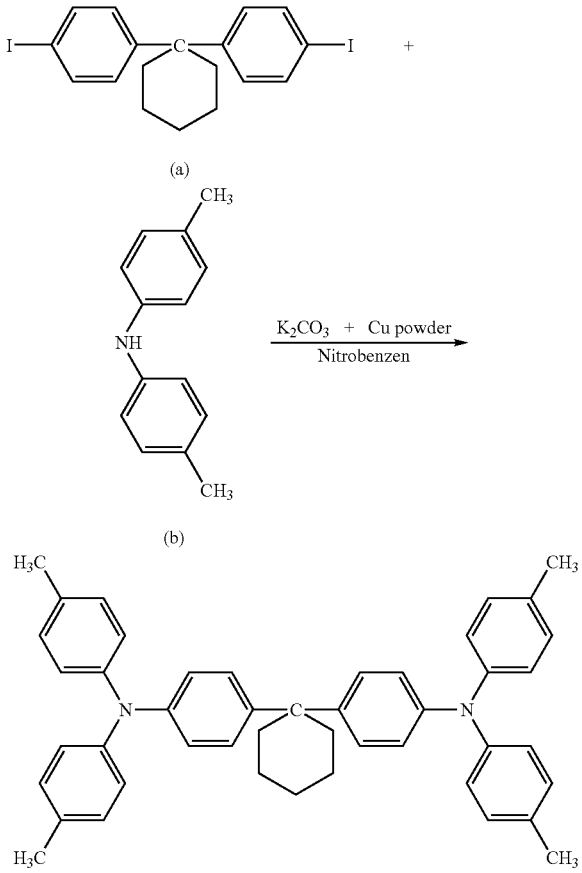

CTM-6

There will be described a synthesis scheme of the foregoing CTM-6. First, a four-necked flask is provided with a cooler, a thermometer and a nitrogen introducing tube and a magnetic stirrer is set thereto. The interior of the flask is evacuated and completely replaced by nitrogen. Into the flask were successively added compounds described below:

| | |
|---|---|
| N,N-bis(4-methylphenyl)aniline | 4.00 parts by mass |
| Cyclohexane | 2.00 parts by mass |
| Acetic acid | 14.00 parts by mass |
| Methanesulfonic acid | 0.09 parts by mass |

This mixture solution is reacted at 70° C. for 8 hr. Thereafter, formed solids are washed with acetone and recrystallized in tetrahydrofuran (THF) and acetone to obtain an objective CTM-6. The thus obtained CTM-6 can be identified by mass spectrometry (MS) or nuclear magnetic resonance (NMR).

In addition to the compound represented by formula (2) or (3) are usable commonly known positive-hole transporting (P-type) charge transfer material (CTM) as a charge transport material (CTM) usable in photoreceptors relating to the invention. Examples thereof include triphenylamine derivatives, hydrazine compounds, styryl compounds, benzidine compounds and butadiene compounds. Using these charge transport materials, a charge transport layer can be formed with a coating solution prepared by dissolving these charge transport materials in an appropriate binder resin. Of charge transport materials described above are preferably used ones which exhibit low absorption of laser light at an emission wavelength of 350 to 500 nm and enhanced charge transportability, and the compound represented by formula (2) or (3) is specifically preferred.

A binder resin usable in the charge transport layer may be any one of thermoplastic resins and thermosetting resins. Specific examples of a binder resin include thermo-plastic resins such as a polystyrene resin, polyacrylic resin, polymethacrylic resin, polyvinyl acetate resin and polyvinyl butyral resin. There are also included condensation type polymer materials such as a polyester resin, polycarbonate resin, epoxy resin and polyurethane resin. Examples of a thermosetting resin include a phenol resin, alkyd resin and melamine resin. In addition to these resins is also usable a silicone resin. There are also usable a copolymer resin having at least two of repeating unit structures constituting the resins described above and resins using at least two of the resins in combination, so-called polymer blends Further, in addition to these resins are also cited polymer organic semiconductors, such as polyvinyl carbazole. Of these resins described above is specifically preferred a polycarbonate resin which exhibits low water absorptivity, capable of performing uniform dispersion of a charge transport material and also exhibits favorable electrophotographic characteristics.

The ratio of charge transport material to binder resin is preferably 50 to 200 parts by mass to 100 parts by mass of a binder resin. The total thickness of a charge transport layer is preferably not more than 30 μm, more preferably 10 to 25 μm. A thickness of more than 30 μm easily causes absorption or scattering of a short wavelength laser within the charge transport layer, resulting in a lowering of image sharpness, which is disadvantageous for high resolution image formation. Further, an increase of residual potential easily occurs, which becomes disadvantageous for repeated image formation.

Next, there will be described feasible image formation using the photoelectric photoreceptor relating to the invention. In the invention, making use of a pyranthrone compound as a charge generation material, containing one to six bromine atoms in the molecule and exhibiting peaks at Bragg angles of 12.3°, 20.5°, 25.3+ and 28.3° has realized excellent image formation upon exposure to light at a lasing wavelength of 350 to 500 nm. It was thus found that superior toner image formation was achieved even when exposed to a short wavelength light at a lasing wavelength of 350 to 500 nm which rendered it difficult to form images in the prior art.

In the following, there will be described an image forming apparatus in which an electrophotographic photoreceptor relating to the invention can be installed.

Figure 1:
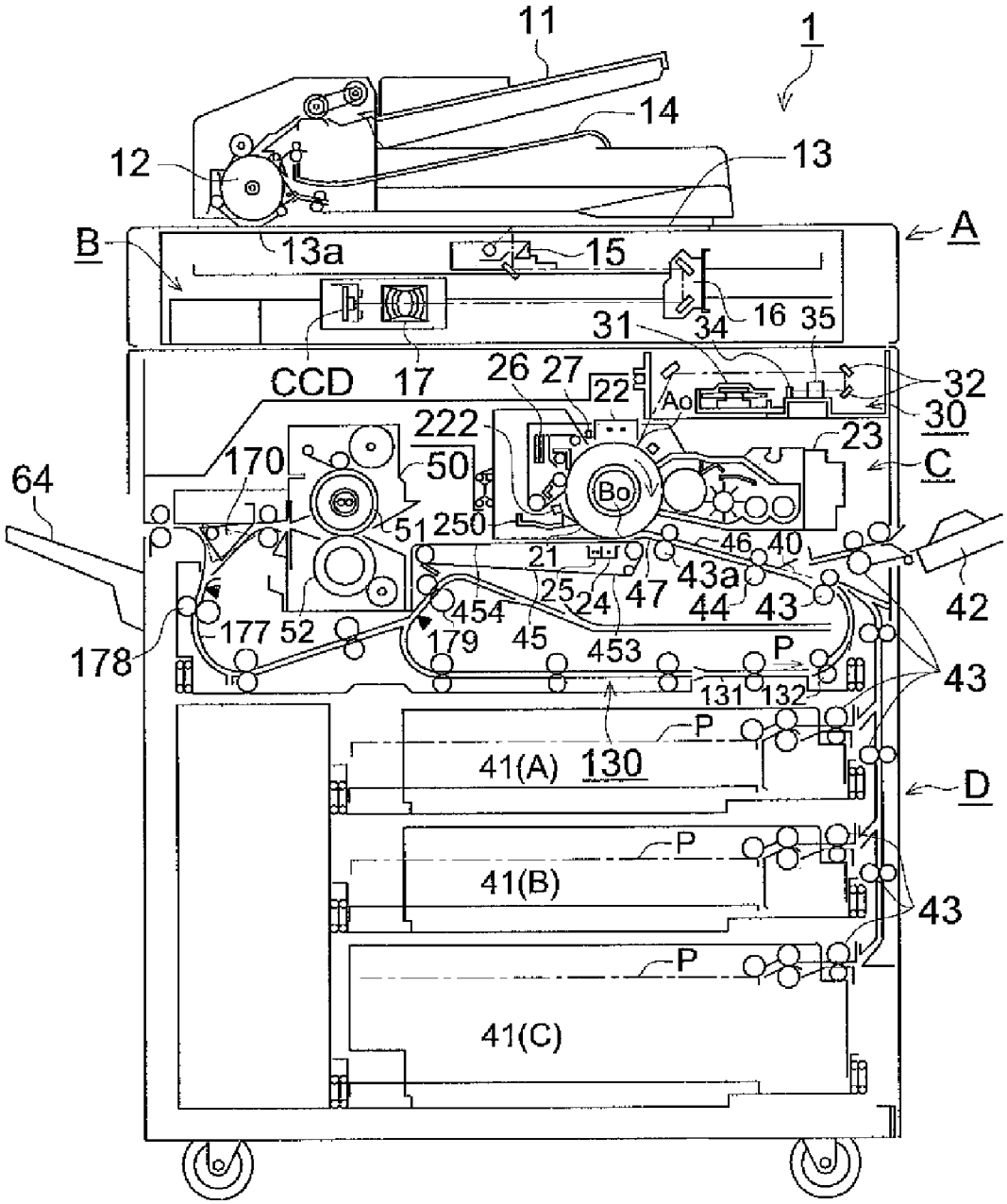
FIG. 1 illustrates a sectional view of an image forming apparatus capable of image formation through a digital system.

In FIG. 1 is shown an example of an image forming apparatus in which an electrophotographic photoreceptor can be loaded. An image forming apparatus 1, which is capable of forming images by a digital system, is composed mainly of an image reading section A, an image processing section B, an image forming section C and a transfer paper conveyance section D. An automatic document feeder to automatically convey documents is provided above the image reading section A and a document held on a document-holding plate 11 is separated and conveyed sheet by sheet by a document conveying roller 12 so that images are read at a reading position 13*a*. A document having completed image reading is disposed onto a document disposing plate by the document conveying roller 12.

The image forming apparatus 1 of FIG. 1 can perform reading by placing a document sheet by sheet on a platen glass 13 as well as automatic image reading, as described above. Reading an original image on the platen glass 13 is achieved by moving each of a lighting lamp constituting a scanning optical system, a first mirror unit 15 comprised of the first mirror and a second mirror unit 16 of a structure disposing two mirrors in a V-form. In the image forming apparatus of FIG. 1, reading an original image is performed at a moving speed of the first mirror unit 15 of "v" and a moving speed of the second mirror unit 16 of "v/2".

The image which has been read on the image reading section A by the procedure described above is converted to a digital image signal in the subsequent image processing section B. In the image processing section B, the image read in the image reading section A is formed on the light-receiving surface of an imaging element CCD of a line-sensor through a projector lens 17. Optical images formed in-line on the imaging element CCD are successively photoelectric-converted to electric signals (luminance signal) and further subjected to A/D (analog/digital) conversion. Then, the digital-converted image signals are subjected to density conversion or a filtering treatment and the formed image data are stored in memory as image signals.

The image formation section C performs toner image formation using digital signals formed in the image processing section B and has a unit structure which is assembled of parts used for image formation, as shown in FIG. 1. The image formation unit constituting the image formation section C includes a drum-form photoreceptor 21, and a charger 22 to charge the photoreceptor 21 (charging step) and a developing device 23 to supply a toner to the photoreceptor 21 (developing step) are disposed on the periphery of the photoreceptor 21. Further on the periphery of the photoreceptor 21 are disposed a transfer-conveying belt device 45 as a transfer means to transfer a toner image formed on the photoreceptor 21 onto paper P, a cleaning device to remove the residual toner on the photoreceptor 21 (cleaning step) and a light charge neutralizer 27 of a pre-charge lamp to neutralize the surface of the photoreceptor 21 in preparation for the subsequent image formation (charge neutralization step). These members of from the charger 22 to the light charge neutralizer are arranged in the order of performance in image formation.

A reflection density detector 222 to measure the reflection density of a patch image developed on the photoreceptor 21 is provided downstream from the developing device 23. The photoreceptor 21 makes use of a pyranthrone compound relating to the invention as a charge generation material, having peaks at Bragg angles of 12.3°, 20.5°, 25.3° and 28.3° in CuKα X-ray diffraction and is rotationally driven in the designated direction or clockwise.

Next, there will be described exposure of the photoreceptor to light. The photoreceptor 21 is rotated by a driving means not shown in the drawing, and the photoreceptor is uniformly charged during rotation by the charger 22 and imagewise exposed by an exposure optical system, designated as an imagewise exposing means 30 (imagewise exposure step), based on image signals called out of the memory of the image processing section B.

The imagewise exposing means 30 which corresponds to a writing means to write image data onto the photoreceptor 21 employs a laser diode not shown, as an emission source and performs main-scanning by an exposure light transmitted by a polygon mirror 31, a fθ lens 34, a cylindrical lens 35 and a reflection mirror 32. The thus transmitted exposure light is irradiated onto the photoreceptor 21 at the position ($A_o$) to perform imagewise exposure with rotating the photoreceptor 21 (sub-scanning) to form a latent image In the invention, a semiconductor laser or an emission diode at an emission wavelength of 350 to 500 nm is used as an exposure light source to form a latent image on the photoreceptor 21. Exposure is performed preferably at 10 to 50 μm of a dot diameter of exposure light from a light source. Exposure using fine-dots of an emission wavelength and an exposure dot diameter falling within the foregoing range enables to form, on the photoreceptor 21, a highly precise dot image which is responsive to digital image formation. Specifically, when the emission wavelength and the exposure dot diameter fall within the foregoing range, high resolution image formation of not less than 1200 dpi (dpi: number of dots per inch or 2.54 cm) is feasible on the photoreceptor 21.

"Exposure dot diameter" refers to the length of an exposure beam along the main-scanning direction and falling within the region where the intensity of the exposure beam is $1e^2$ or more of the peak intensity. Examples of a light sources of the exposure beam include a scanning optical system using a semiconductor laser and a solid scanner using a light-emitting diode (LED). The intensity of the exposure beam may be represented in terms of Gauss distribution or Lorentz distribution, but in the invention, the light intensity distribution is not necessarily specified if formed dots exhibit a diameter of 10 to 50 μm in the region of being $1/e^2$ or more of peak intensity.

A surface-emitting laser array having at least three laser beam emitting points in length and width, which can achieve rapid-writing of latent images on the photoreceptor, is preferable for high-speed print making. Rapid preparation of prints at stable image quality becomes feasible by performing light-exposure with a surface-emitting laser array onto the photoreceptor relating to the invention which can stably form latent images even when repeating image formation.

A latent image formed on the photoreceptor 21 is developed by supplying a toner with the developing device 23 to form a visible toner image on the surface of the photoreceptor 21. To realize high-precise image formation responsive to digital imaging, it is preferred to use a polymer toner for a developer supplied by the developing device 23. Specifically, such a polymer toner can be prepared by controlling the form or particle size distribution in the process of production. Accordingly, the combined use of a toner, the form and size of which have been controlled in the process of polymerization, and a pyranthrone compound exhibiting peaks at Bragg angles of 12.3°, 20.5°, 25.3° and 28.3° can achieve high-precise image formation of superior sharpness.

The transfer paper conveying section D conveys, toward the subsequent fixing device (50), the paper P onto which a toner image formed at the periphery of the photoreceptor 21 in the image forming section C is transferred by a transfer means 45. The transfer paper conveying section D is provided with paper feeding units 41(A), 41(B) and 41(C) of transfer paper housing means for housing paper sheets differing in size under the image forming unit. Further, a manual paper feed unit 42 for manual paper feeding is provided laterally to the paper feed unit. The transfer paper P is selected by any one of these transfer paper housing means and fed by a guide roller 43 along a transfer path 40.

The transfer paper conveyance section D is provided with paired paper feed resist rollers 44 to adjust inclination or deviation of fed transfer paper P. The transfer paper P is temporarily stopped by the paper feed resist rollers 44 and then again fed. The thus fed transfer paper P is guided to the transfer path 40, a transfer-preceding roller 43*a*, paper feed path and an entrance guide plate 47.

The toner image formed on the photoreceptor 21 is transferred onto the transfer paper P at the transfer position ($B_o$) by a transfer pole 24 and a separation pole 25. The transfer paper P is subject to transfer of the toner image on the paper surface, while being conveyed by a transfer conveyance belt 454 of the transfer mean 45 (transfer-conveyance belt device). The transfer paper P onto which a toner image has been transferred is separated from the surface of the photoreceptor 21 and conveyed by the transfer means 45 toward the fixing device 50.

The fixing device 50 is provided with a fixing roller 51 and a pressure roller 52 and when the transfer paper P passes between the fixing roller 51 and the pressure roller 52, the toner image on transfer paper P is fixed through heating and applying pressure. After the toner image is fixed onto the transfer paper P, the transfer paper P is discharged onto a paper-receiving tray 64.

According to the foregoing procedure, the image forming apparatus of FIG. 1 transfers a toner image onto one side of the transfer paper P to prepare a print material formed of an image on one side. There can also be prepared a print material having toner images transferred onto both sides of the transfer paper P.

In case when toner images are formed on both sides of the transfer paper P, a paper ejection switching member 170 of the transfer paper conveyance section D is operated to open a transfer paper guide 177, whereby the transfer paper P having a toner image formed on one side is conveyed in the direction indicated by the dashed arrow. The transfer paper P is conveyed downward by a conveyance mechanism 178 and switches back at a transfer paper-reversing portion 179, and the back end of the transfer paper P becomes the top end and is transferred to the inside of a dual print paper-supplying unit 130.

The transfer paper P moves in the paper-supplying direction along a conveyance guide 131 provided in the dual print paper-supplying unit 130 and the transfer paper P is again inserted in a web roller 132 and guided to the transfer path 40. According to the procedure described above, the transfer paper P is conveyed toward the photoreceptor 21, and after a toner image is transferred onto the back surface of the transfer paper P and fixed by the fixing device 50, the transfer paper P is discharged onto a copy receiving tray 64. Following the foregoing steps, there can be prepared a print having toner images on both surfaces of the transfer paper P.

The image forming apparatus shown in FIG. 1 may employ a system in which constituent elements such as the photoreceptor 21, the developing device 21, the cleaner 21 and the like are integrated to form a so-called process cartridge of a unit structure which is easily detachable from the main body of the apparatus. In addition to unitization of plural constituent elements such a process cartridge as described above, at least one of a charger, an imagewise exposure device, a developing device, a transfer or separation device and a cleaner may be integrated with the photoreceptor 21 to form a cartridge unit which is easily detachable from the apparatus body.

A toner image formed by using the electrophotographic photoreceptor relating to the invention is finally transferred onto the transfer paper P and fixed thereto through the fixing step. The transfer paper P is a support to hold a toner image, which is usually called an image support, a recording material or a transfer material. Specific examples thereof include copy paper of plain paper or high quality paper, coated paper for printing such as art paper or coat paper, commercially available Japanese paper or post card paper, plastic film used for OHP and cloth but are not limited to these in the invention.

EXAMPLES

The invention will be further described with reference to examples but the embodiments of the invention are by no means limited to these. In the following example, "part(s)" represents part(s) by mass, unless otherwise noted.

1. Preparation of Pyranthrone Compounds 1-9

(1) Synthesis of Pyranthrone Compound:

Reaction was performed according to the procedure of the synthesis method afore-described to obtain a pyranthrone compound with four attached bromine atoms. Reaction was also performed similarly to the foregoing, except that an amount of bromine to be added in the reaction process was changed to 1.5 parts by mass, whereby a pyranthrone compound with a single attached bromine atom was obtained. Reaction was also performed similarly to the foregoing, except that an amount of bromine to be added in the reaction process was changed to 9.0 parts by mass, whereby a pyranthrone compound with six attached bromine atoms was obtained.

Further, when each of the above-described pyranthrone compounds with attached bromine atoms was subjected to CuKα x-ray diffractometry, there were not observed peaks at Bragg angles (2θ±0.2°) of 12.3°, 20.5°, 25.3° and 28.3°. The number of attached bromine atoms of each of the pyranthrone compounds was confirmed in mass spectrometry by using a commercially available mass spectrometer.

(2) Purification of Pyranthrone Compound:

The pyranthrone compound with four attached bromine atoms was purified with varying the number of sublimation treatments. A compound which was subjected to the purification treatment only once was designated as compound 1, a compound which was subjected to the purification treatment twice was designated as compound 2, and a compound which was subjected to the purification treatment three times was designated as compound 3. The thus obtained compounds 1-3 were each subjected to CuKα x-ray diffractometry. The compounds 1 and 2 each exhibited peaks at Bragg angles of 12.3°, 20.5°, 25.3° and 28.3° and some peaks at other angles were also observed. Specifically in the compound 1, there was not observed difference in peak height between peaks at 12.3°, 20.5°, 25.3° and 28.3° and those at other angles, and of the peaks at other angles was observed a peak higher than the peaks at 12.3°, 20.5°, 25.30° and 28.3°. On the contrary, the compound 2 exhibited peaks at 12.3°, 20.5°, 25.3° and 28.3° which were higher than the peaks at other angles. Further, the compound 3 exhibited markedly high peaks at 12.3°, 20.5°, 25.3° and 28.3° and any other peak was difficult to observe visually.

The pyranthrone compound with a single attached bromine atom was twice subjected to the sublimation treatment similarly to the compound 2 and was designated as compound 4. The thus obtained compound 4 was also subjected to CuKα X-ray diffractometry and exhibited peaks at Bragg angles of 12.3°, 20.5°, 25.3° and 28.3°, but some other small peaks were also observed.

The pyranthrone compound with six attached bromine atoms was subjected to the sublimation treatment twice or three times similarly to the compound 2 or the compound 3. The compound which was subjected to the sublimation treatment twice was designated as compound 5, and the compound which was subjected to the sublimation treatment three times was designated as compound 6.

The thus obtained compounds 5 and 6 were each subjected to CuKα X-ray diffractometry and exhibited peaks at Bragg angles of 12.3°, 20.5°, 25.3° and 28.3°, but the compound S also exhibited small peaks at other angles. In the compound 6, there was not visually observed any peak other than the peaks at 12.3°, 20.5°, 25.3° and 28.3°.

(3) Preparation of Compound 7:

After the pyranthrone compound with four attached bromine atoms was subjected to the first sublimation treatment, 1.0 part by mass of the compound purified by sublimation was dissolved in 30 parts by mass of sulfuric acid to perform an acid pasting treatment. Thereafter, the thus treated mixture was poured into 500 parts by mass of ice, filtered and washed with water until the washing water became neutral, and dried to obtain compound 7 having an amorphous structure.

(4) Preparation of Compounds 8 and 9:

8,16-pyranthrenedione as a pyranthrone compound having no attached bromine atom was treated in the same manner as for the foregoing compound 7, whereby compound 8 of an amorphous structure was obtained. Further, the foregoing 8,16-pyranthrenedione was subjected to the sublimation treatment three times in the same manner as compound 3, whereby compound 9 was prepared. The compound 9 was also subjected to CuKα X-ray diffractometry and was observed to exhibit a few peaks at Bragg angles different than 12.3°, 20.5°, 25.3° and 28.3°.

Nine pyranthrone compounds were thus prepared according to the above-described procedures.

2. Preparation of Photoreceptors 1-13

Based on the following procedure, an interlayer, a charge generation layer and a charge transfer layer were successively formed on a cylindrical support to prepare photoreceptors 1-13.

First, the surface of a cylindrical aluminum support was machined to prepare an electrically conductive support exhibiting a ten-point surface roughness of 15 μm.

Formation of Interlayer

On the above-described conductive support was coated by the dip-coating method an interlayer coating solution composed of the composition described below, and dried at 120° C. for 30 min. to form an interlayer of 1.0 μm dry thickness. The interlayer coating solution was prepared in the manner described below, then diluted twice with mixed solvents which were used in the preparation of the coating solution, allowed to stand for one day and night and finally filtered. Filtration was conducted using Rigimesh Filter (nominal filtration accuracy: 5 μm, produced by Nippon Pall Co.) under pressure of 50 kPa.

The above-described components were mixed and batchwise dispersed for 10 hr. by using a sand mill, and then, the coating solution was prepared according to the procedure described above.

Preparation of Charge Generation Layer

| | |
|---|---|
| Charge generation material | 24.0 parts |
| Polyvinyl butyral resin S-LEC BL-1 (produced by Sekisui Kagaku Co.) | 12.0 parts |
| 2-Butanine/cyclohexanone mixture (volume ratio: 4/1) | 300 parts |

As a charge generation material (also denoted simply as CGM) were used compounds 1-9, as afore-described. The above-described composition was mixed and dispersed by a sand mill to prepare a coating solution of a charge generation layer. This coating solution was coated on the interlayer described above by the dip coating method to form a dry thickness of 0.5 μm. Charge generation materials used for the individual photoreceptors are shown in Table 1.

Preparation of Charge Transport Layer

| | |
|---|---|
| Charge transport material | 225.0 parts |
| Polycarbonate Z300 (produced by Mitsubishi Gas Kagaku) | 300.0 parts |
| Antioxidant Irganox 1010 (Nihon Ciba-Geigy KK) | 6.0 parts |
| Tetrahydrofurane/toluene mixture (volume ratio: 3/1) | 2000.0 parts |
| Silicone oil KF-54 (produced by Shinetsu Kagaku Co.) | 1.0 part |

As a charge transport material (hereinafter, also denoted simply as CTM) was used either one of CTM-6 described above and CTM-X described below. The above-described composition was mixed and dispersed by using a sand mill to prepare a coating solution for a charge transport layer. The coating solution was coated on the foregoing charge generation layer by the dip coating method to form a charge transport layer of a 20 μm dry thickness. Charge transport materials used for the individual photoreceptors are shown in Table 1.

| | |
|---|---|
| Binder resin (polyamide, as below) | 1.0 part |

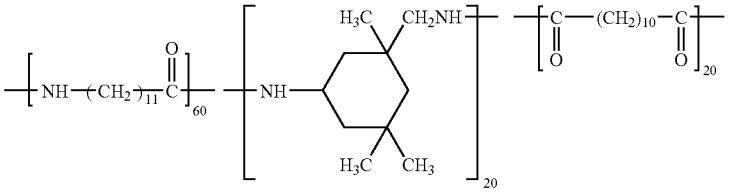

| | |
|---|---|
| Rutile-form titanium oxide* (primary particle size: 35 nm) | 3.5 parts |
| Solvent (ethanol/n-propyl alcohol/tetrahydrofuran, 45/20/30 by mass) | 10.0 parts |

*surface-treated with copolymer of methyl hydrogen siloxane and dimethylsiloxane (molar ratio 1:1) in an amount of 5% by mass of the total titanium oxide

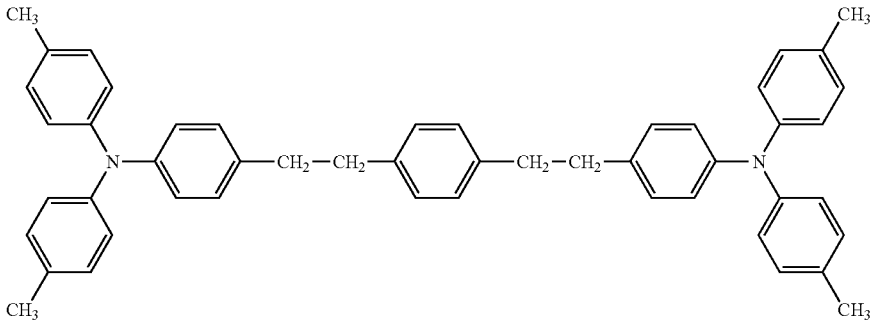

CTM-X

According to the above-described procedure were prepared photoreceptors 1-13, as shown in. Table 1.

3. Preparation of Toner K (Black Developer)

(1) Preparation of Resin Particle Dispersion 1

The following compounds were placed into a flask equipped with a stirrer and dissolved to prepare a mixture solution and then heated to 80° C.

| | |
|---|---|
| Pentaerythritol tetra-stearic acid ester | 72.0 parts |
| Styrene | 115.1 parts |
| n-butyl acrylate | 42.0 parts |
| methacrylic acid | 10.9 parts |

Into a separable flask equipped with a stirrer, a temperature sensor, a cooling tube and a nitrogen-introducing device was placed 7.08 g of an anionic surfactant (sodium dodecylbenzenesulfonate or SDS) dissolved in 2760 parts by mass of deionized water and heated to 80° C., while stirring at a rate of 230 rpm under a nitrogen gas stream. Subsequently, using a mechanical dispersing machine with a circulation pathway, CLEAR MIX (M TECHNIQUE Co., Ltd.), the above described mixture solution (80° C.) was added to the above-described surfactant solution (80° C.) and mixed to prepare an emulsion in which emulsified particles of uniform size oil droplets were dispersed.

To this dispersion was added an initiator solution of 0.84 part by mass of a polymerization initiator (potassium persulfate or KPS) dissolved in 200 parts by mass of deionized water and heated at 80° C. for 3 hrs. to perform polymerization. To this reaction mixture was added a solution of 7.73 parts by mass of a polymerization initiator (KPS) dissolved in 240 parts by mass of deionized water and heated at 80° C. for 15 min., then, a mixture solution composed of compounds described below was dropwise added over 100 min.

| | |
|---|---|
| Styrene | 383.6 parts |
| n-Butyl acrylate | 140.0 parts |
| Methacrylic acid | 36.4 parts |
| n-Octylmercaptan | 12 parts |

This mixture was heated at 80° C. for 60 min with stirring and cooled to 40° C. to prepare a wax-containing resin particle dispersion [hereinafter, also denoted as Latex (1)].

(2) Preparation of Colorant Dispersion

Into 160 parts by mass of deionized water was dissolved with stirring 9.2 parts by mass of sodium n-dodecylsulfate. Into this solution was gradually added with stirring 20 parts of carbon black MOGAL L (produced by Cabbot Co.). Subsequently, a dispersing treatment was conducted using a mechanical dispersing machine CLEAR MIX (M TECHNIQUE Co., Ltd.) to prepare colorant dispersion K. The colorant particle size of the colorant dispersion K was measured using an electrophoretic light scattering photometer ELS-800 (produced by Otsuka Denshi Co., Ltd.) and the weight average particle size was proved to be 120 nm.

(3) Preparation of Colorant Particle K

Into a reaction vessel fitted with a temperature sensor, a cooling tube, a stirrer (provided with two stirring blades at a crossing angle of 20°) and a shape-monitoring device was added the composition described below:

| | |
|---|---|
| Latex (1) | 1250 parts (solids) |
| Deionized water | 2000 parts |
| Colorant dispersion K | total amount |

After the internal temperature was adjusted to 25° C., to this dispersion mixture was added an aqueous 5 mol/liter sodium hydroxide to adjust the pH to 10.0.

Subsequently, an aqueous solution of 52.6 parts by mass of magnesium chloride hexahydrate dissolved in 72 parts by mass of deionized water was added over 10 min., while stirring at 25° C. Then, the temperature of the system was promptly raised to 95° C. over 5 min. (at a rate of 14° C./min).

During this state, the particle size of coagulated particles was measured using MULTISIZER 3 (produced by Beckman Coulter Co.) and when the particles reached a volume-based median diameter (D50) of 6.5 μm, an aqueous solution of 115 parts by mass of sodium chloride dissolved in 700 parts by mass of deionized water was added thereto to terminate particle growth. Further, stirring (at a rate of 120 rpm) was continued for 8 hr. at 90° C. to perform ripening to continue fusion. Thereafter, this system was cooled to 30° C. at a rate of 10° C/min and the pH was adjusted to 3.0 with hydrochloric acid and stirring was terminated.

The thus formed particles were filtered off, repeatedly washed with deionized water, subjected to submerged classification by using a centrifugal separator and then dried by using a flush jet drier to obtain colored particles K having a water content of 1%.

(4) Preparation of Toner K

To the foregoing colored particles K were added 0.8 part by mass of a hydrophobic silica exhibiting a number average primary particle size of 12 nm and a hydrophobilization degree of 65 and 0.5 part by mass of a hydrophobic titania exhibiting a number average primary particle size of 30 nm and a hydrophobilization degree of 55 and mixed in a HENSCHEL MIXER to prepare toner K. The thus prepared toner K exhibited a volume-based median diameter (D50) of 6.5 μm.

Further to the foregoing toner K was added a silicone resin-coated ferrite carrier exhibiting a volume-based median diameter (D50) of 45 μm to prepare a black developer having a toner concentration of 6%.

4. Evaluation Experiment (1) Evaluation-1

Using an electrostatic copying paper test apparatus EPA-8100 (produced by Kawaguchi Denki Co., Ltd.), photoreceptors 1-13 were each evaluated with respect to sensitivity and repetition characteristics, as follows.

Sensitivity:

Each of the photoreceptors was electrically charged so that the surface potential became −700 V, then, exposed to a 420 nm monochromatic light separated by a monochrometer and the amount of light necessary to allow the surface potential to decay to −350 V to determine sensitivity (E1/2).

Sensitivities for monochromatic light of 350 nm and 500 nm were also determined similarly.

Repetition Characteristic:

The initial dark potential (Vd) and the initial light potential (Vl) were each set to −700 V and −200 V, respectively and charging and exposure were repeated 300 times using a 400 nm monochromatic light to determine variations of Vd and Vl (denoted as ΔVd, ΔVl).

The foregoing results are shown in Table 1, in which minus sign represents lowering of potential and the plus represents rising of potential.

TABLE 1

| | | | Sensitivity (μJ/cm²) | | | Repetition Characteristic (V) | | |
|---|---|---|---|---|---|---|---|---|
| Photoreceptor No. | CGM | CTM | 350 | 420 | 500 | ΔVd | ΔVl | Remark |
| 1 | Compound 2 | CTM-6 | 0.27 | 0.19 | 0.26 | −10 | 8 | Inv. |
| 2 | Compound 3 | CTM-6 | 0.24 | 0.14 | 0.25 | −10 | 5 | Inv. |
| 3 | Compound 3 | CTM-X | 0.25 | 0.18 | 0.26 | −10 | 9 | Inv. |
| 4 | Compound 4 | CTM-X | 0.29 | 0.20 | 0.29 | −15 | 10 | Inv. |
| 5 | Compound 5 | CTM-X | 0.28 | 0.20 | 0.29 | −12 | 10 | Inv. |
| 6 | Compound 6 | CTM-6 | 0.25 | 0.14 | 0.25 | −10 | 5 | Inv. |
| 7 | Compounds 3/6* | CTM-6 | 0.24 | 0.15 | 0.26 | −10 | 5 | Inv. |
| 8 | Compounds 3/4** | CTM-6 | 0.26 | 0.17 | 0.27 | −10 | 7 | Inv. |
| 9 | Compound 1 | CTM-6 | 0.30 | 0.20 | 0.28 | −14 | 9 | Inv. |
| 10 | Compound 1 | CTM-X | 0.31 | 0.22 | 0.30 | −18 | 15 | Inv. |
| 11 | Compound 7 | CTM-6 | 0.34 | 0.25 | 0.34 | −23 | 34 | Comp. |
| 12 | Compound 8 | CTM-6 | 0.36 | 0.26 | 0.35 | −26 | 36 | Comp. |
| 13 | Compound 9 | CTM-6 | 0.32 | 0.23 | 0.31 | −20 | 20 | Comp. |

*Compounds 3/6 = Compound 3 (12 parts) + Compound 6 (12 parts)

**Compounds 3/4 = Compound 3 (12 parts) + Compound 4 (12 parts)

As shown in Table 1, it was proved that photoreceptors 1 through 10 were each superior in sensitivity and repetition characteristics, compared to photoreceptors 11 through 13.

(2) Evaluation-2

Using the photoreceptors 1-13, as shown in Table 1 and a black developer, image evaluation was conducted in a modified machine of a commercially available digital printer Di351 (produced by Konica Minolta Business Technology Inc.) having a basic constitution, as shown In FIG. 1. Using the above-described machine, exposure to a short wavelength laser light was conducted with varying an exposure wavelength and an exposure diameter in the main-scanning direction, as shown in Table 2 and intermittent printing was performed on 3,000 sheets of high quality A4 paper (64 g/m²) under the respective exposure conditions.

The intermittent printing was set so that when a print in process of making was conveyed onto a copy receiving tray, the subsequent was started. Printing was conducted under an environment of ordinary temperature and ordinary humidity (20° C., 55% RH) and image evaluation was made using printed materials outputted at about the 40th sheet and also at about the 3,000th sheet. There was used a face-emitting laser array having three laser beams each in the longitudinal and lateral directions, respectively, as an exposure device of the short wavelength laser light.

Image evaluation was made with respect to black-spotting, dot reproducibility and fine-line reproducibility. The image outputted in printing was an A4 size image (7% in terms of pixel ratio), in which a fine-line image (8 lines/mm, 6 lines/mm, 4 lines/mm), a halftone image (image density of 0.8), a white background image and a solid image (image density of 1.30), each equally accounting for a quadrant of the sheet.

Black-Spotting:

Black-spotting was evaluated in such a manner that the number of visually observable black spots (having a diameter of 0.4 mm or more) formed on the about 40th and 3000th sheets and from the observation results, evaluation was made by equivalence conversion to the number of spots on the A4 size sheet. It was evaluated that the number of 10 spots/A4 size or less was acceptable and the number of 3 spots/A4 size or less was specifically preferable.

Dot Reproducibility

When reached bout the 40th and 3000th sheets during printing, printing was conducted by varying the exposure diameter of the laser beam and independency of dots forming a halftone image on the print was evaluated through observation with a magnifier at 10-fold magnification. Specifically, printing was performed with varying the exposure beam diameter in the writing main-scanning direction to 10 μm, 21 μm or 50 μm, provided that the exposure diameter of 38th and 2998th sheets was set to 10 μm, that of 39th and 2999th sheets was set to 21 μm, and that of 40th and 3000th sheets was set to 50 μm. An exposure beam diameter of 10 μm corresponds to the dot number of approximately 2500 dpi, that of 21 μm corresponds to the dot number of approximately 1200 dpi and that of 50 μm corresponds to the dot number of approximately 500 dpi. Observation results were evaluated based on the following criteria, in which ranks A to C were acceptable in practice.

A: It was confirmed that dots constituting halftone images were each independently formed at each of 10 μm (corresponding to 250 dpi), 21 μm (corresponding to 1200 dpi) and 50 μm (corresponding to 500 dpi), whereby excellent high image quality was achieved;

B: dot independency was evident in halftone images of 21 μm (corresponding to 1200 dpi) and 50 μm (corresponding to 500 dpi), but dot independency was insufficient in halftone images of 10 μm (corresponding to 2500 dpi);

C: dot independency was evident in halftone images of 50 μm (corresponding to 500 dpi), but dot independency was insufficient in halftone images of 10 μm (corresponding to 2500 dpi) and 21 μm (corresponding to 1200 dpi);

D: independency of dots was insufficient even in a halftone image of 50 μm (corresponding to 500 dpi).

Fine-line Reproducibility:

Fine-line reproducibility was evaluated in fine-line images printed on the 39th and 2999th sheets. The fine-line portion was magnified by a 10-fold magnifier and the number of fine-lines per 1 mm was visually evaluated. Specifically, as described above, fine-line images were composed of three kinds of fine-line images at 8 line/mm, 6 line/mm and 4 line/mm, in which a fine-line image with a thin or thick portion on the fine-line was judged to be a defective print but a fine-line image in which no thin or thick portions were observed at 6 line/mm or more was evaluated as acceptable.

Results of the foregoing are shown in Table 2.

TABLE 2

| | | Laser | Black Spotting (spot/A4) | | Dot Image Reproducibility | | Fine-Line Reproducibility (line/mm) | |
|---|---|---|---|---|---|---|---|---|
| | Photoreceptor No. | Wavelength (nm) | 40th Sheet | 3000th Sheet | 40th Sheet | 3000th Sheet | 40th Sheet | 3000th Sheet |
| Example 1 | 1 | 420 | 3 | 4 | A | B | 8 | 8 |
| Example 2 | 2 | 420 | 0 | 1 | A | A | 8 | 8 |
| Example 3 | 2 | 350 | 1 | 1 | A | B | 6 | 6 |
| Example 4 | 2 | 500 | 0 | 1 | A | A | 8 | 8 |
| Example 5 | 3 | 420 | 1 | 3 | A | A | 8 | 6 |
| Example 6 | 4 | 420 | 4 | 6 | B | B | 6 | 6 |
| Example 7 | 5 | 420 | 4 | 5 | A | B | 6 | 6 |
| Example 8 | 5 | 350 | 4 | 8 | B | B | 6 | 6 |
| Example 9 | 5 | 500 | 4 | 4 | A | B | 8 | 6 |
| Example 10 | 6 | 420 | 0 | 1 | A | A | 8 | 8 |
| Example 11 | 7 | 420 | 0 | 1 | A | A | 8 | 8 |
| Example 12 | 8 | 500 | 2 | 3 | A | A | 8 | 8 |
| Example 13 | 8 | 420 | 3 | 3 | A | B | 8 | 6 |
| Example 14 | 9 | 420 | 5 | 7 | A | B | 8 | 6 |
| Example 15 | 10 | 420 | 8 | 10 | B | C | 6 | 6 |
| Comparison 1 | 11 | 500 | 12 | 17 | C | D | 4 | * |
| Comparison 2 | 12 | 500 | 16 | 21 | C | D | * | * |
| Comparison 3 | 12 | 420 | 15 | 22 | D | D | * | * |
| Comparison 4 | 13 | 500 | 10 | 14 | B | C | 6 | 4 |

*: Defective print

As shown in Table 2, the use of the electrophotographic receptors of the invention has achieved satisfactory results in black spotting, dot image reproduction and fine-line reproduction. Specifically, satisfactory image formation resulted even at an exposure light wavelength of 350 nm at which it was difficult to form favorable image. Thus, it was proved from the results of the foregoing examples that image formation with a short wavelength laser light of 350-500 nm was effectively performed by use of electrophotographic photoreceptors of the invention. On the contrary, as is apparent from the results of comparisons 1-4, the use of the electrophotographic photoreceptors falling outside the invention did not achieve intended results in black spotting, dot image reproduction and fine-line reproduction, further, no satisfactory image formation was realized even at an exposure light wavelength of 500 nm.

What is claimed is:

1. An electrophotographic photoreceptor comprising on or over an electrically conductive support a photosensitive layer containing a pyranthrone compound represented by the following formula (1) and the pyranthrone compound has a crystal structure exhibiting a CuKα X-ray diffraction spectrum having peaks only at angles (2θ±0.2°) of 12.3°, 20.5°, 25.3° and 28.3°:

formula (1)

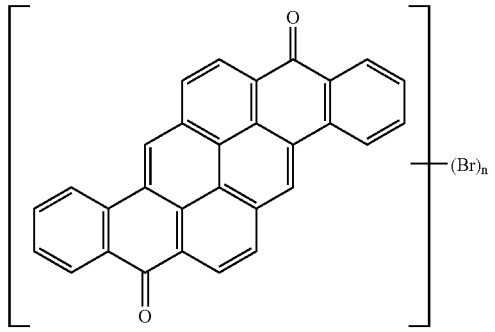

wherein n is an integer of 1 to 6.

2. The photoreceptor of claim 1, wherein the photosensitive layer comprises a charge generation layer containing a charge generation material and a charge transport layer containing a charge transport material and the charge generation material comprises the pyranthrone compound.

3. The photoreceptor of claim 2, wherein the charge generation layer further contains a binder and a weight ratio of the charge generation material to the binder is 20 to 600 parts by mass to 100 parts by mass of the binder.

4. The photoreceptor of claim 2, wherein the charge transport material comprises a compound represented by the following formula (2):

formula (2)

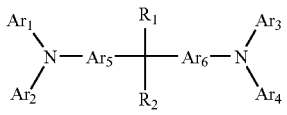

wherein $Ar_1$ to $Ar_4$ are each independently an aryl group, $Ar_5$ and $Ar_6$ are each an arylene group, provided that $Ar_1$ and $Ar_2$ or $Ar_3$ and $Ar_4$ may combine together with each other to form a ring; $R_1$ and $R_2$ are each independently a hydrogen atom or an alkyl group, an aralkyl group or aryl group, provided that $R_1$ and $R_2$ may combine together with each other to form a ring.

5. The photoreceptor of claim 4, wherein the compound represented by the formula (2) is represented by the following formula (3):

formula (3)

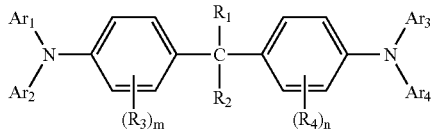

wherein $R_1$ and $R_2$ are each independently an alkyl group or an aryl group, provided that $R_1$ and $R_2$ may combine together with each other to form a ring; $R_3$ and $R_4$ are each independently a hydrogen atom, an alkyl group or an aryl group; $Ar_1$ to $Ar_4$ are the same as defined in the formula (2); m and n are each an integer of 1 to 4.

6. The photoreceptor of claim 2, wherein the charge transport layer further contains a binder and a weight ratio of the charge generation material to the binder is 50 to 200 parts by mass to 100 parts by mass of the binder.

7. The photoreceptor of claim 1, wherein the conductive support exhibit a specific resistivity of not more than $10^3$ 106 cm.

8. The photoreceptor of claim 1, wherein the photoreceptor further comprises an interlayer between the conductive support and the photosensitive layer and the interlayer contains a particulate N-type semiconductor.

9. The photoreceptor of claim 8, wherein the N-type semiconductor is a titanium oxide or a zinc oxide.

10. The photoreceptor of claim 8, wherein the particulate N-type semiconductor has a number average primary particle size of 3 to 200 nm.

11. An electrophotographic image forming method comprising:

exposing an electrophotographic photoreceptor to a light to form an electrostatic latent image by using an exposure device having an emission wavelength of 350 to 500 nm and an exposure dot diameter of 10 to 50 μm in the main scanning direction of writing and developing the latent image to form an electrophotographic image, wherein the photoreceptor is exposed and the electrophotographic photoreceptor comprises on or over an electrically conductive support a photosensitive layer containing a pyranthrone compound represented by the following formula (1) and the pyranthrone compound has a crystal structure exhibiting a CuKα X-ray diffraction spectrum having peaks only at angles (2θ±0.2°) of 12.3°, 20.5°, 25.3° and 28.3°:

formula (1)

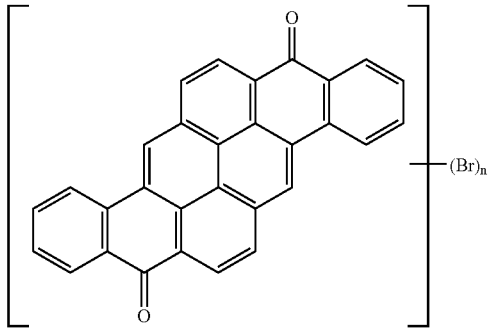

wherein n is an integer of 1 to 6.

12. The method of claim 11, wherein the photosensitive layer comprises a charge generation layer containing a charge generation material and a charge transport layer containing a charge transport material and the charge generation material comprises the pyranthrone compound.

13. The method of claim 12, wherein the charge transport material comprises a compound represented by the following formula (2):

formula (2)

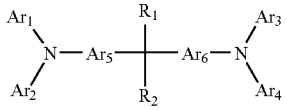

wherein $Ar_1$ to $Ar_4$ are each independently an aryl group, $Ar_5$ and $Ar_6$ are each an arylene group, provided that $Ar_1$ and $Ar_2$ or $Ar_3$ and $Ar_4$ may combine together with each other to form a ring; $R_1$ and $R_2$ are each independently a hydrogen atom or an alkyl group, an aralkyl group or aryl group, provided that $R_1$ and $R_2$ may combine together with each other to form a ring.

14. The method of claim 13, wherein the compound represented by the formula (2) is represented by the following formula (3):

formula (3)

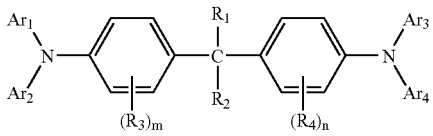

wherein $R_1$ and $R_2$ are each independently an alkyl group or an aryl group, provided that $R_1$ and $R_2$ may combine together with each other to form a ring; $R_3$ and $R_4$ are each independently a hydrogen atom, an alkyl group or an aryl group; $Ar_1$ to $Ar_4$ are the same as defined in the formula (2); m and n are each an integer of 1 to 4.

15. The method of claim 11, wherein the exposure device is a surface-emitting laser array having at least three laser beam emitting points in length and width directions.

* * * * *